US007481757B2

(12) United States Patent
Spiers et al.

(10) Patent No.: US 7,481,757 B2
(45) Date of Patent: Jan. 27, 2009

(54) TUBE ROLLING DEVICE

(75) Inventors: Steven F. Spiers, Richmond, VA (US); Jeremy J. Straight, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 79 days.

(21) Appl. No.: 11/647,036

(22) Filed: Dec. 28, 2006

(65) Prior Publication Data

US 2008/0160123 A1 Jul. 3, 2008

(51) Int. Cl.
*B31C 13/00* (2006.01)

(52) U.S. Cl. ..... 493/39; 493/47

(58) Field of Classification Search ..... 493/39, 493/42, 46, 47, 48, 49, 50; 131/29, 32, 36, 131/61.1, 88, 89; 53/461, 203, 204, 211, 53/216

See application file for complete search history.

(56) References Cited

U.S. PATENT DOCUMENTS 2,952,105 A * 9/1960 Schur ..... 493/39
3,081,778 A * 3/1963 Dearsley ..... 493/39
3,354,887 A * 11/1967 Vanmeda ..... 493/42
3,961,633 A * 6/1976 Schubert et al. ..... 493/48
3,985,144 A 10/1976 Payne
4,492,238 A * 1/1985 Wheless ..... 493/43
5,024,242 A * 6/1991 Garthaffner et al. ..... 131/94
5,984,851 A * 11/1999 Irikura ..... 493/39
6,131,582 A 10/2000 Draghetti
7,226,404 B2 * 6/2007 Rizzoli et al. ..... 493/39
7,338,421 B2 * 3/2008 Eusepi et al. ..... 493/39
2002/0119874 A1 * 8/2002 Heitmann et al. ..... 493/39
2006/0196513 A1 * 9/2006 Atwell et al. ..... 493/39
2006/0281614 A1 * 12/2006 Scott et al. ..... 493/39

FOREIGN PATENT DOCUMENTS

FR 2096237 * 11/1972

* cited by examiner

*Primary Examiner*—Louis K Huynh
(74) *Attorney, Agent, or Firm*—Connolly Bove Lodge & Hutz LLP

(57) ABSTRACT

Method and apparatus for forming filter tubes comprises delivering a filter element to a flute on a first drum having vacuum for securing the filter element thereto. First and second tube forming rollers axially engage opposite ends of the filter element. A second drum accepts and cuts a continuous paper web with a glue pattern thereon into paper pieces, and a cut paper piece is delivered to the filter element. The paper piece is then rolled around the filter element and the tube forming rollers to form a cylindrical shape. The tube forming rollers are axially disengaged to thereby produce a filter tube with hollow ends and a control positioned filter element.

17 Claims, 3 Drawing Sheets

TUBE ROLLING DEVICE

FIELD OF THE INVENTION

The present invention relates to a device for rolling tubes of cigarette plug wrap with single or multiple internal filter elements.

SUMMARY OF THE INVENTION

Cigarette filter rods can be processed in pairs in the so-called "two-up" filter rod configuration. According to this configuration, one solid filter plug is placed in the middle of a tube created using plug wrap so that an empty space is created on either end of the filter plug. The empty space may then be filled with a sequence of granular material, such as carbon and the like, and solid material, such as cellulose acetate fibers or fibers with flavorant. Upon completion, a tobacco rod may be joined to each end of the filter tube using tipping paper, and the central solid filter may then be cut in half to form two cigarettes.

The plug wrap can wrinkle or become folded as it is rolled around the filter material. Thus, there is a need for an apparatus and method for rolling plug wrap around a filter plug that avoids the disadvantages of the prior art. Thus, the present invention relates to a device and method for rolling wrinkle-free and crease-free hollow tubes of plug wrap with single or multiple internal filter elements.

In accordance with the present invention, a method of forming filter tubes comprises delivering a filter element to a flute on a first drum having a vacuum for securing the filter element thereto, and axially engaging opposite ends of the filter element with first and second tube forming rollers. A continuous web of paper with a glue pattern thereon is delivered to a second drum. The paper is cut into discrete pieces, and at least a portion of the paper piece is delivered to at least a portion of the filter element in the flute of the first drum. The paper piece is rolled around the filter element and the tube forming rollers to form a cylindrical shape. The tube forming rollers are then disengaged to thereby produce a filter tube with hollow ends and a centrally positioned filter element.

The apparatus of the present invention comprises a flute on a first drum for accepting a filter element, the flute having vacuum for securing the filter element thereto. First and second tube forming rollers axially engage opposite ends of the filter element. A second drum accepts and cuts a continuous web of paper with a glue pattern thereon into paper pieces and delivers a cut paper piece to the filter element. A belt contacts the paper piece to roll the paper piece around the filter element.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION

Embodiments of the present invention will now be described with reference to the drawings.

Figure 1:
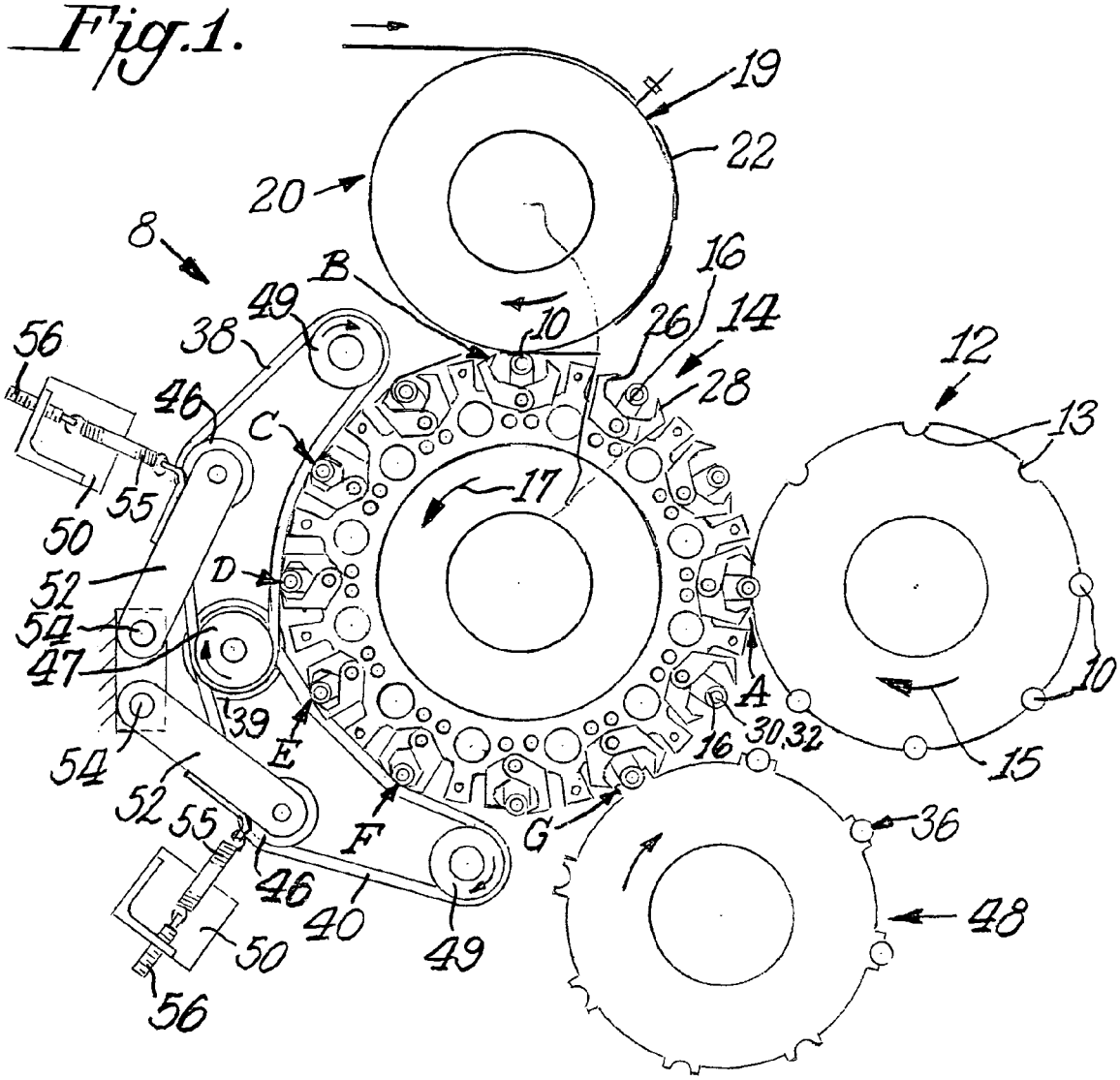
FIG. 1 is a side elevational view showing a tube rolling device.

FIG. 1 is a side elevational view that schematically shows a cigarette filter tube rolling apparatus 8 according to an embodiment of the present invention. The apparatus may include a feed drum 12, tube rolling drum 14, tipping drum 20, rolling belt 38, pressure belt 40, and take-off drum 48. Generally speaking, a filter element 10 may travel from the feed wheel 12, to tube rolling drum 14 where paper patches 22 may be applied and rolled around the filter element 10. Paper 22 may be supplied from tipping drum 20, and may have glue along its centerline of travel in order to secure plug wrap paper 22 to filter element 10. Rolling belt 38 may drive the paper circumferentially around the filter element until glue applied at the trailing edge of the plug wrap paper engages with another surface of the paper wrapped around the filter element 10 to form a filter tube 36. Filter tube 36 may then be placed on and removed from take-off wheel 48 in a conventional manner for further processing. The novel process and apparatus for rolling paper around the filter elements will now be described in greater detail. For purposes of illustration, certain positions during the rolling process will be designated with letters representing a particular point during the process.

Filter element 10 may be any conventional element of a smoking article filter, such as a plug of cellulose acetate tow or other suitable material. Filter element 10 may be provided in any conventional manner to a filter feed drum 12 comprising at least one flute 13 for accepting filter elements. For example, filter element 10 may be manually placed in flute 13 or may be delivered to the flute from a filter element creation and/or distribution apparatus. Flute 13 may be a generally semi-circular tubular shaped opening along the perimeter of the drum 12. Flute 13 may comprise a vacuum or other suitable means conventional in the art to hold filter element 10 as the feed drum rotates in a clockwise direction as illustrated with the arrow 15 in FIG. 1.

As filter elements 10 arrive at position A, they may be transferred to a flute 16 on tube rolling drum 14 that may rotate in a counter-clockwise direction as illustrated by arrow 17. Flute 16 may be a generally semi-circular tubular shaped opening along the perimeter of the drum 14. The filter elements 10 may be held in the drum flutes 16 by a vacuum or other suitable means conventional in the art.

Figure 4:
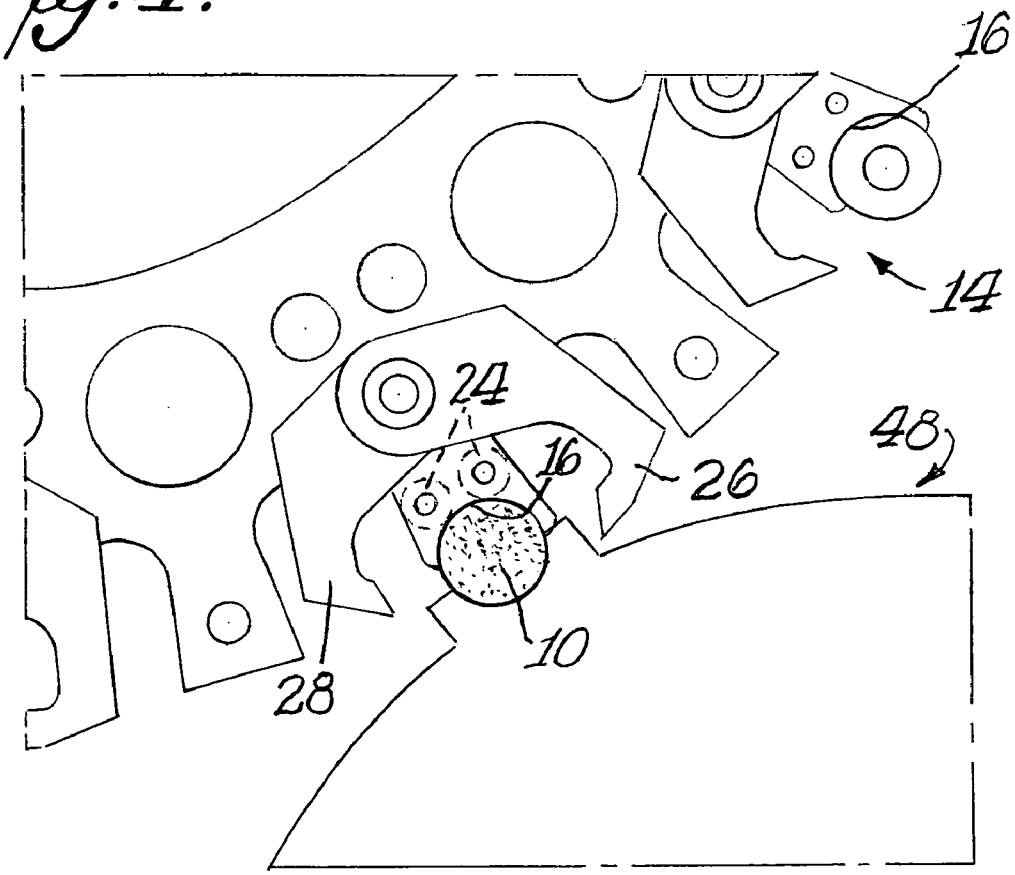
FIG. 4 is a fragmental side elevational view with the tube forming roller removed and showing the formed tube filter being transferred from the tube forming drum to the tube removal drum.

Each flute 16 in the tube rolling drum 14 may equipped with rollers 24, which are designated by hidden lines shown in FIG. 4. Rollers 24 may be generally cylindrically shaped and may be free-spinning or may have a driving means to spin filter element 10. Rollers 24 may be provided in pairs to allow filter element 10 and paper 22 to rotate freely during the rolling process.

Figure 5:
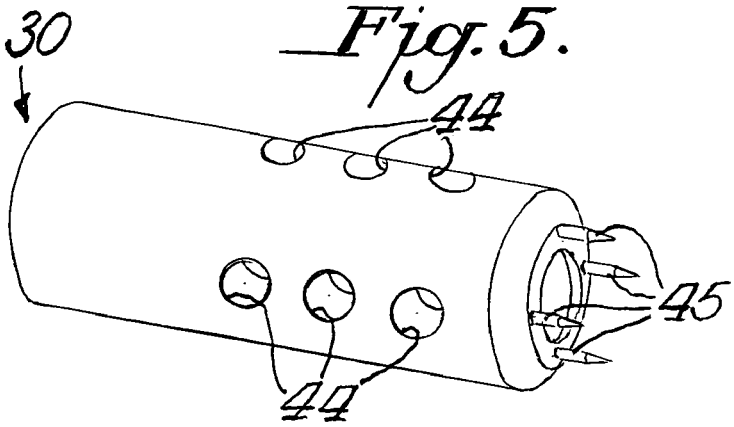
FIG. 5 is a perspective view of a modified idler tube forming roller showing vacuum ports and filter holding pins.
Figure 6:
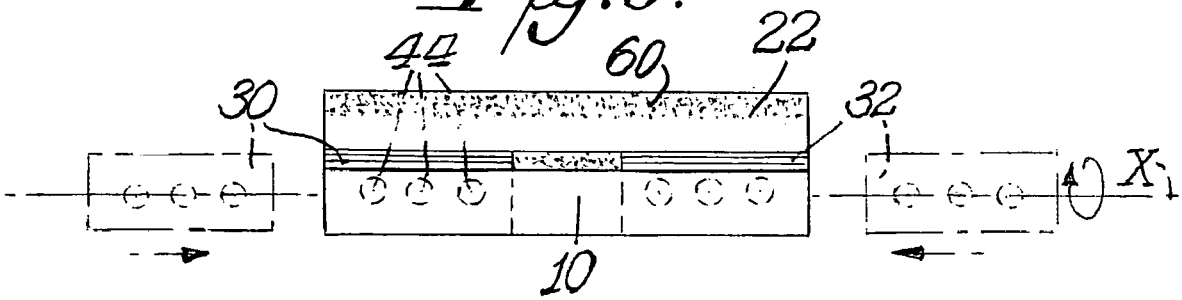
FIG. 6 is a schematic side elevational view showing a tube strip being wrapped around a filter and two suction idler tube forming rollers.
Figure 7:
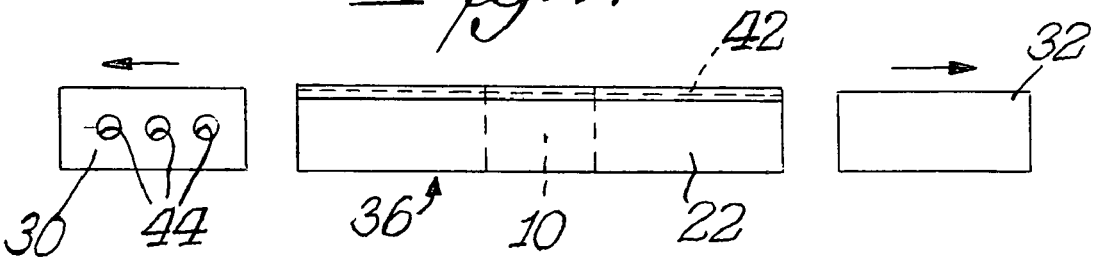
FIG. 7 is a schematic side elevational view showing a finished filter tube with a centrally positioned filter and with the idler tube forming rollers removed.

Each flute 16 may also be equipped with tube forming rollers 30 and 32, shown in FIGS. 5-7. Tube forming rollers 30 and 32 may be generally cylindrically shaped and provided to hold the filter element 10 in place during the rolling operation and/or to prevent paper 22 from wrinkling or folding during the rolling process. Tube forming rollers 30 and 32 may be moved axially along the flute on each side of filter element 10 to enclose the filter element along its axis X and may rotate with filter element 10 on rollers 24 during rolling. This axial motion is well known as described in U.S. patent application Ser. No. 11/443,659, which is hereby incorporated by reference for all useful purposes. The movement and position of the tube forming rollers may be controlled by cams, which are not shown, but are well known to those skilled in the art, as disclosed, for example, in U.S. Pat. No. 3,985,144, which is hereby incorporated by reference for all useful purposes.

In Position A, indicated in FIG. 1, tube forming rollers 30 and 32 (not shown in FIG. 1) are separated by a distance sufficient to allow filter element 10 to be generally positioned within flute 16. As the tube rolling drum 14 rotates to position B, tube forming rollers 30 and 32 may be directed axially inwardly toward filter element 10 to secure it in a predetermined position, for example, in the center of flute 16.

Figure 3:
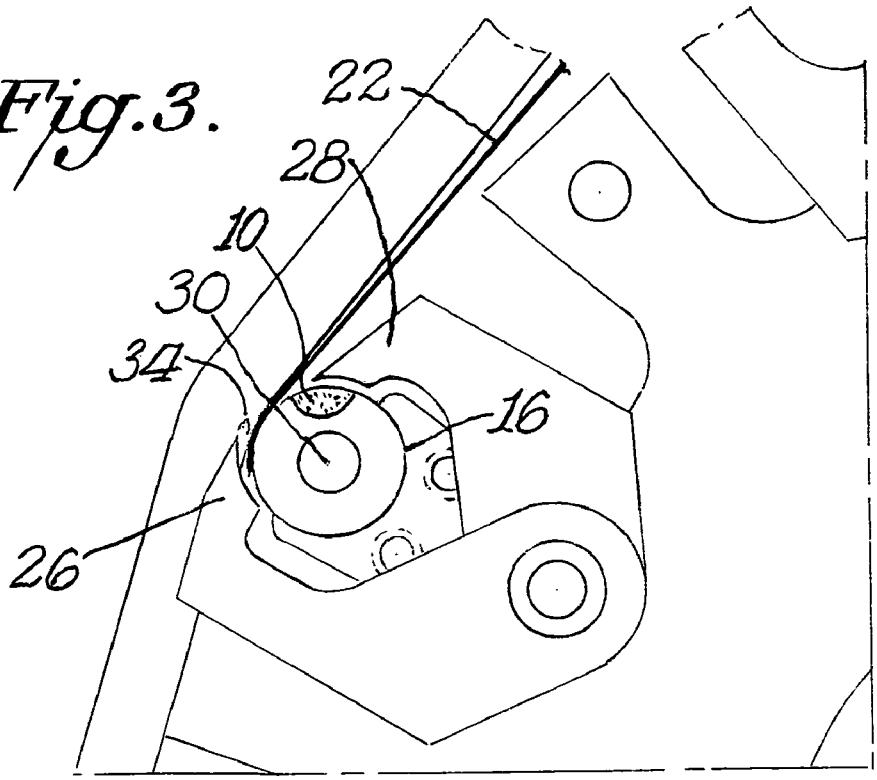
FIG. 3 is a fragmental side elevational view showing the cut paper tube strip entering the right and left cowl between the rolling belt and idler tube forming roller.

Each flute 16 may also be equipped with cowls 26 and 28, shown in FIGS. 1, 3 and 4. The movement and position of these cowls may be controlled by cams, which are not shown, but are well known to those skilled in the art. Cowls 26 and 28 may be moved in a grasping or scissor motion to close around the filter element 10 and idler tube forming rollers 30 and 32.

Filter elements 10 can be brought in proximity with tipping drum 20 to be paired with paper segments 22. To deliver a cut segment 22 of paper to the filter element 10, a continuous web of paper 18 may be delivered to the tipping drum 20 where it can be cut into individual cut paper segments 22. Paper segments 22 may have a glue pattern that is pre-applied when the paper is still continuous or the glue may be applied after the step of cutting. Continuous paper 18 may be cut using a blade 19, cutting wheel, or other suitable cutting device conventional in the art. The paper feed and cutting process may be the same as employed in conventional cigarette filter tipping machinery.

At position B, a leading edge of paper segment 22 (hereafter simply "paper") is stuck to filter element 10 by virtue of the patterned glue. Paper 22 is left to extend generally tangentially to filter element 10. As tube rolling drum 14 rotates from position B to position C, cowls 26 and 28 pivot inwardly toward the filter element 10 and tube forming rollers 30 and 32. This pivoting does not appreciably interfere with the paper, which at this point in the process may still extend tangentially away from filter element 10.

The process of rolling paper 22 around element 10 may be commenced at position C. FIG. 3 shows an enlarged view of filter element 10 at position C and shows the positioning of the cowls 26 and 28 relative to the filter element 10 at position C of the process. When the cowls are closed inwardly, a slight gap 34 may remain between cowl 26 and filter element 10 and, therefore, tube forming rollers 30 and 32. A similar gap may exist between cowl 28 and filter element 10. Gap 34 serves as a guide path for the paper 22 during the rolling process. The guide path assists in preventing the paper from wrinkling and folding back during rolling. As also shown in FIG. 3, cowl 28 may be separated from contact with belt 38 to allow paper 22 to be advanced without being pinched between cowl 28 and belt 38.

At position C, one or more rolling belts 38 come into contact with paper 22 and the vacuum is disengaged at least slightly. A belt may be provided to contact paper 22 in the regions of tube forming rollers 30 and 32. The rolling belt 38 may be driven by a motor 39 and guided by wheels 46, 47 and 49 to run at a higher speed than the surface speed of paper 22, which is controlled by the rotational speed of rolling drum 14. Tension in belt 38 may be maintained using tensioners 50, which are attached to an arm 52 that pivots about a fixed point 54. Tensioners 50 may comprise, for example, springs 55 which may be tightened or loosened using tension screws 56, as is well known in the art for adjusting tension in a tensioning system. Thus, as the tube rolling drum 14 rotates from position C to position D, the rolling belts 38, which have a surface speed that is faster than the rotational speed of rolling drum 14, push paper 22 through gap 34 and around filter element 10 and tube forming rollers 30 and 32 in the flute 16, as shown in FIG. 6. Thus, as shown with general reference to FIGS. 6 and 7, paper 22 is rolled around filter element 10 and tube forming rollers 30 and 32 until a trailing edge of glue 60 on the paper seals the seam by contacting with a portion of the paper that has been rolled around filter element 10 and tube forming rollers 30 and 32.

When the filter tube 36 reaches position E, a pressure belt 40 comes into contact with the filter tube 36. Belt 40 may be positioned between two belts 38 all of which may rotate on independent wheels 47 to allow belts 38 to contact paper 22 around tube forming rollers 30 and 32 and to allow belt 40 to contact paper 22 around filter element 10. Additionally, wheels 47 may spin freely of each other so that one of the wheels 47 may allow belts 38 to move faster than the rotational speed of drum 14, while another of the wheels 47 may rotate at a matched speed relative to drum 14. Although FIG. 1 shows only one of the wheels 47, it should be understood that other independently rotating wheels 47 may be axially aligned with the wheel 47 shown as is known in the art of tension belt systems.

Belt 40 may run at a matched speed with the tube 36 and drum 14 so that belt 40 may hold tube 36 tight against the surface of flute 16. The pressure of belt 40 may assist in maintaining tube 36 in position as the tube forming rollers 30 and 32 are removed. The vacuum may also be reengaged at this point to maintain tube 36 in position.

The pressure belt 40 may be tensioned using tensioners 50 as described above with reference to rolling belt 38. As tube rolling drum 14 rotates from position E to position F, tube forming rollers 30 and 32 are axially withdrawn. This action can be observed by comparing FIG. 6 with FIG. 7.

Figure 2:
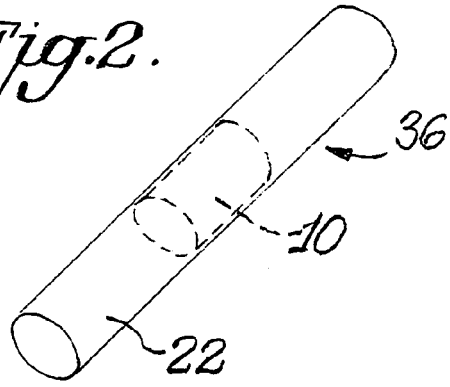
FIG. 2 is a perspective view of a finished rolled tube with a filter in a central position.

As the tube rolling drum 14 rotates from Position F to Position G, the left and right cowls 26 and 28 open up. The finished rolled filter tube 36 is then removed at position G, as shown in FIG. 4. The vacuum may again be disengaged to allow transfer to drum 48. An exemplary finished filter tube 36 is shown in FIG. 2.

Alternatively or additionally, tube forming rollers 30 and 32 may be provided with vacuum holes 44 and/or filter engaging pins 46 as shown in FIG. 5. Vacuum could be applied through the vacuum holes 44 to pull paper 22 down tightly against the surface of the tube forming rollers 30 and 32 to further ensure that paper 22 follows the guide path during the rolling operation. Optional pins 46 could penetrate into the end surfaces of filter element 10 to ensure that the filter element 10 and tube forming rollers 30 and 32 roll together.

It should be understood that the above detailed description while indicating preferred embodiments of the invention are given by way of illustration only since various changes and modifications within the spirit and scope of the invention will become apparent to those skilled in the art from the detailed description.

What is claimed is:

1. A method of forming filter tubes comprising:

delivering a filter element to a flute on a first drum, the flute having a vacuum for securing the filter element thereto;

axially engaging opposite ends of the filter element with first and second tube forming rollers;

delivering a continuous web with a glue pattern thereon to a second drum;

cutting the web into discrete pieces;

delivering at least a portion of the web piece to at least a portion of the filter element in the flute of the first drum;

rolling the web piece around the filter element and the tube forming rollers to form a cylindrically shaped structure; and axially disengaging the tube forming rollers to produce a filter tube with hollow ends and a centrally positioned filter element;

wherein the first drum further comprises left and right cowls that circumferentially engage around the filer element with a gap between each of the cowls and the filter element for guiding the web piece during the step of rolling the web piece around the filter element and the tube forming rollers, the step of rolling the web piece around the filter element and the tube forming rollers further comprising engaging the cowls and guiding the web piece through the gap between each of the cowls and the filter element.

2. The method according to claim 1, wherein the filter element is delivered to the flute on the first drum from a filter feed drum.

3. The method according to claim 1, wherein the step of rolling the web piece around the filter element and the tube forming rollers further comprises engaging the filter element with a roller situated within the flute of the first drum, the roller within the flute of the first drum allowing the filter element and web piece to roll easily during the rolling process.

4. The method according to claim 3, wherein the step of rolling the web piece around the filter element and the tube forming rollers further comprises engaging the web piece with a rolling belt to feed the web piece through the gap between the left cowl and the filter element, along the roller within the flute of the first drum, and then through the gap between the right cowl and the filter element.

5. The method according to claim 4, wherein a trailing edge of the web piece is provided with glue for attaching the trailing edge of the web piece to a portion of the web piece rolled around the filter element to form a glued tube.

6. The method according to claim 5, wherein the step of disengaging the tube forming rollers further comprises contacting the glued tubes in the area of the filter element with a pressure belt for securing the tube in the flute in the first drum while the tube forming rollers are axially withdrawn.

7. The method according to claim 1, wherein the cowls are disengaged after the tube forming rollers are axially disengaged.

8. The method according to claim 1, wherein the cowls are engaged after the tube forming rollers are axially engaged.

9. The method according to claim 1, further comprising removing the filter tube from the first drum using a third drum.

10. An apparatus for rolling filter tubes comprising:

a flute on a first drum for accepting a filter element, the flute having a vacuum for securing the filter element thereto;

first and second tube forming rollers for axially engaging opposite ends of the filter element;

a second drum for accepting and cutting a continuous web with a glue pattern into pieces and delivering a cut web piece to the filter element; and a belt for contacting the web piece to roll the web piece around the filter element;

wherein the first drum further comprises left and right cowls that engage generally circumferentially around the filter element with a gap between each of the cowls and the filter element for guiding the web piece around the filter element and the tube forming rollers.

11. The apparatus according to claim 10, wherein the filter element is delivered to the flute on the first drum from a filter feed drum, the filter element being held to the filter feed drum by a vacuum provided at a flute on the feed drum.

12. The apparatus according to claim 10, further comprising a roller within the flute of the first drum allowing the filter element and web piece to roll easily.

13. The apparatus according to claim 12, wherein a trailing edge of the web piece is provided with glue for attaching the trailing edge of the web piece to a portion of the web piece rolled around the filter element to form a glued web tube.

14. The apparatus according to claim 13, further comprising a pressure belt for securing the tube in the flute in the first drum so that the tube forming rollers can be axially withdrawn.

15. The apparatus according to claim 10, further comprising a third drum for removing the filter tube from the first drum.

16. The apparatus according to claim 10, wherein the tube forming rollers each include vacuum holes for applying a vacuum to the web piece to hold the web piece against the surface of the tube forming rollers.

17. The apparatus according to claim 10, wherein the tube forming rollers each include pins for penetrating into the filter element to ensure that the filter element and tube forming rollers roll together.

* * * * *